US009266003B2

(12) United States Patent
Luo

(10) Patent No.: US 9,266,003 B2
(45) Date of Patent: Feb. 23, 2016

(54) FOLDABLE BALL NET FRAME

(71) Applicant: IRI-GREAT INTERNATIONAL LTD., Dongguan (CN)

(72) Inventor: Chun Fang Luo, Dongguan (CN)

(73) Assignee: IRI-GREAT INTERNATIONAL LTD., Dongguan, Guangdong (CN)

( * ) Notice: Subject to any disclaimer, the term of this patent is extended or adjusted under 35 U.S.C. 154(b) by 37 days.

(21) Appl. No.: 14/223,757

(22) Filed: Mar. 24, 2014

(65) Prior Publication Data

US 2014/0296002 A1 Oct. 2, 2014

(30) Foreign Application Priority Data

Mar. 29, 2013 (CN) ..... 2013 2 0156317 U

(51) Int. Cl.

| | |
|---|---|
| ***A63B 69/00*** | (2006.01) |
| ***A63B 63/00*** | (2006.01) |
| *A63B 69/36* | (2006.01) |
| *A63B 71/02* | (2006.01) |
| *A63B 57/00* | (2015.01) |
| *A63B 47/02* | (2006.01) |

(52) U.S. Cl.

CPC ..... *A63B 69/0097* (2013.01); *A63B 63/00* (2013.01); *A63B 47/02* (2013.01); *A63B 57/0056* (2013.01); *A63B 69/0002* (2013.01); *A63B 69/3623* (2013.01); *A63B 71/022* (2013.01); *A63B 2069/0006* (2013.01); *A63B 2071/024* (2013.01); *A63B 2209/02* (2013.01); *A63B 2210/50* (2013.01); *A63B 2225/093* (2013.01)

(58) Field of Classification Search

CPC .. A63B 63/00; A63B 69/3623; A63B 71/022; A63B 69/0097; A63B 57/0056; A63B 69/0002; A63B 2069/0006; A63B 2225/093

USPC ..... 473/422, 421, 415, 196, 197, 454, 195, 473/439, 478, 434, 435; 273/400, 407

See application file for complete search history.

(56) References Cited

U.S. PATENT DOCUMENTS

| | | | | |
|---|---|---|---|---|
| 3,184,235 | A * | 5/1965 | Hilbrich | 473/421 |
| 3,856,301 | A * | 12/1974 | Davidson | 473/439 |
| 4,711,260 | A * | 12/1987 | Wiens et al. | 473/195 |
| 4,947,499 | A * | 8/1990 | Rilovich | 5/633 |
| 4,949,979 | A * | 8/1990 | Wheatcroft | 473/197 |
| 5,039,104 | A * | 8/1991 | Holbrook | 473/197 |
| 5,342,063 | A * | 8/1994 | O'Brien et al. | 473/454 |
| 5,562,288 | A * | 10/1996 | Erkebaev | 473/197 |
| 5,810,363 | A * | 9/1998 | Saunders et al. | 473/197 |
| 5,830,076 | A * | 11/1998 | Borys | 473/173 |
| 6,083,114 | A * | 7/2000 | Bailey | 473/196 |
| 2010/0081513 | A1 * | 4/2010 | La Pointe | 473/478 |

* cited by examiner

*Primary Examiner* — Mitra Aryanpour

(57) ABSTRACT

A foldable ball net frame includes a main pipe, a foldable net frame, a stop ring, support poles, and a net. The foldable net frame includes an upper collar and a lower collar. One end of a main support arm of the foldable net frame is hingedly connected to the upper collar, and another end is hingedly connected to one end of a secondary support arm. Another end of the secondary support arm is hingedly connected to the lower collar. The stop ring is disposed between the upper nest and the lower nest and locked on the main pipe. The support poles and the main support arms are coaxially structured. The support poles are disposed at the distal ends of the main support arms, respectively. The net has buttonholes and is detachably connected to the distal ends of the support poles therethrough.

10 Claims, 9 Drawing Sheets

FOLDABLE BALL NET FRAME

BACKGROUND OF THE INVENTION

1. Field of the Invention

The present invention relates to a sporting recreation apparatus, and more particularly to a foldable ball net frame for the users to pick up balls conveniently for ball games and amusements.

2. Description of the Prior Art

A conventional rebound device or a rebound net is developed for football training, ball games and the like. By using the rebound device or rebound net, balls rebound for the user to pick up the balls conveniently. In general, the rebound device or rebound net comprises a net frame and an elastic net. The elastic net is connected to the net frame. For convenient carrying and storage, an assembled net frame is developed accordingly. The net frame is assembled by connecting a plurality of pipes. This structure is not convenient for use and its rebound effect is not good. When the ball hits the net, the net frame may displace, topple or loosen.

U.S. early Publication No. US20100081513A1 discloses a golf hitting device. The device comprises a plurality of foldable support arms between an open position and a closed position. Each support arm has a front end and a rear end. The front end of each support arm has a front end surface at the open position. The device further comprises a shaft which is connected to the support arms and extends toward the rear ends of the support arms. When the shaft is pushed forward, the support arms are folded. When the shaft is pushed rearward, the support arms are unfolded. The device further comprises a net which is installed on the support arms and can be folded along with the support arms. When the support arms are unfolded, the net forms a concave at the front end for balls to pass therethrough.

The aforesaid device adopts a reverse umbrella-shaped structure to enhance the strength of the support and is more convenient for use. However, because the reverse umbrella-shaped structure is different from the normal use habit, it can't provide enough rebound force subject to the folding structure. Therefore, it is still inconvenient for use and also has the problems of displacement, collapse or looseness when the ball hits the net.

Accordingly, the inventor of the present invention has devoted himself based on his many years of practical experiences to solve this problem.

SUMMARY OF THE INVENTION

The primary object of the present invention is to provide a foldable ball net frame which provides great elasticity and can be used conveniently and is durable against impact.

In order to achieve the aforesaid goal, the foldable ball net frame of the present invention comprises a main pipe, a foldable net frame, a stop ring, and a net. The foldable net frame comprises an upper collar fixed at the top of the main pipe and a lower collar slidably fitted on the main pipe. The foldable net frame further comprises four main support arms and four secondary support arms corresponding to the main support arms, respectively. One end of each main support arm is hingedly connected to the upper collar. Another end of each main support arm is hingedly connected to one end of the corresponding secondary support arm. Another end of each secondary support arm is hingedly connected to the lower collar. The stop ring is disposed between the upper collar and the lower collar and locked on the main pipe. The present invention further comprises support poles. The support poles correspond in number to the main support arms. The support poles and the main support arms are coaxially structured. The support poles are disposed at the distal ends of the main support arms, respectively. The net has buttonholes corresponding in number to the support poles. The net is detachably connected to the distal ends of the support poles through the buttonholes.

When the lower collar is moved toward the upper nest along the main pipe to meet the stop ring, the secondary support arms bring the main support arms to move toward the front end of the main pipe to be unfolded in a Y shape, the net is connected to the support poles through the buttonholes and tightens the distal ends of the support poles, and adjacent two of the support poles and the main pipe form a tripod configuration to support the entire net frame on the ground. When the net is detached from the support poles, the lower net is moved away from the upper nest along the main pipe and the secondary support arms bring the main support arms to move toward the rear end of the main pipe to fold the net frame.

Compared to the prior art, the present invention has the following benefits.

1. When the lower collar is moved toward the upper collar along the main pipe to meet the stop ring, the secondary support arms bring the main support arms to move toward the front end of the main pipe to unfold in a Y shape. The net is connected to the support poles through the buttonholes and tightens the distal ends of the support poles. Adjacent two of the support poles and the main pipe form a tripod configuration to support the entire net frame on the ground. After the net is detached from the support poles, the lower collar is moved away from the upper collar along the main pipe and the secondary support arms bring the main support arms to move toward the rear end of the main pipe to fold the net frame. Thus, the user can unfold or fold the net frame of the present invention with ease by himself/herself. The present invention has a simple structure, is convenient for use and operation, has great elasticity, and is durable against impact.

2. The present invention comprises a lock mechanism. The lock mechanism comprises a joint, a pull member, a lock pin, a stop member, and a spring. When in use, the lock pin is adjusted to be engaged in one of adjustment notches in adjustment of the inclined angle between the foldable pip and the main pipe so as to adjust the rebound angle of the net. The structure of the present invention is stable and can be operated quickly and conveniently. It is convenient for user to use the present invention.

DETAILED DESCRIPTION OF THE PREFERRED EMBODIMENTS

Figure 1:
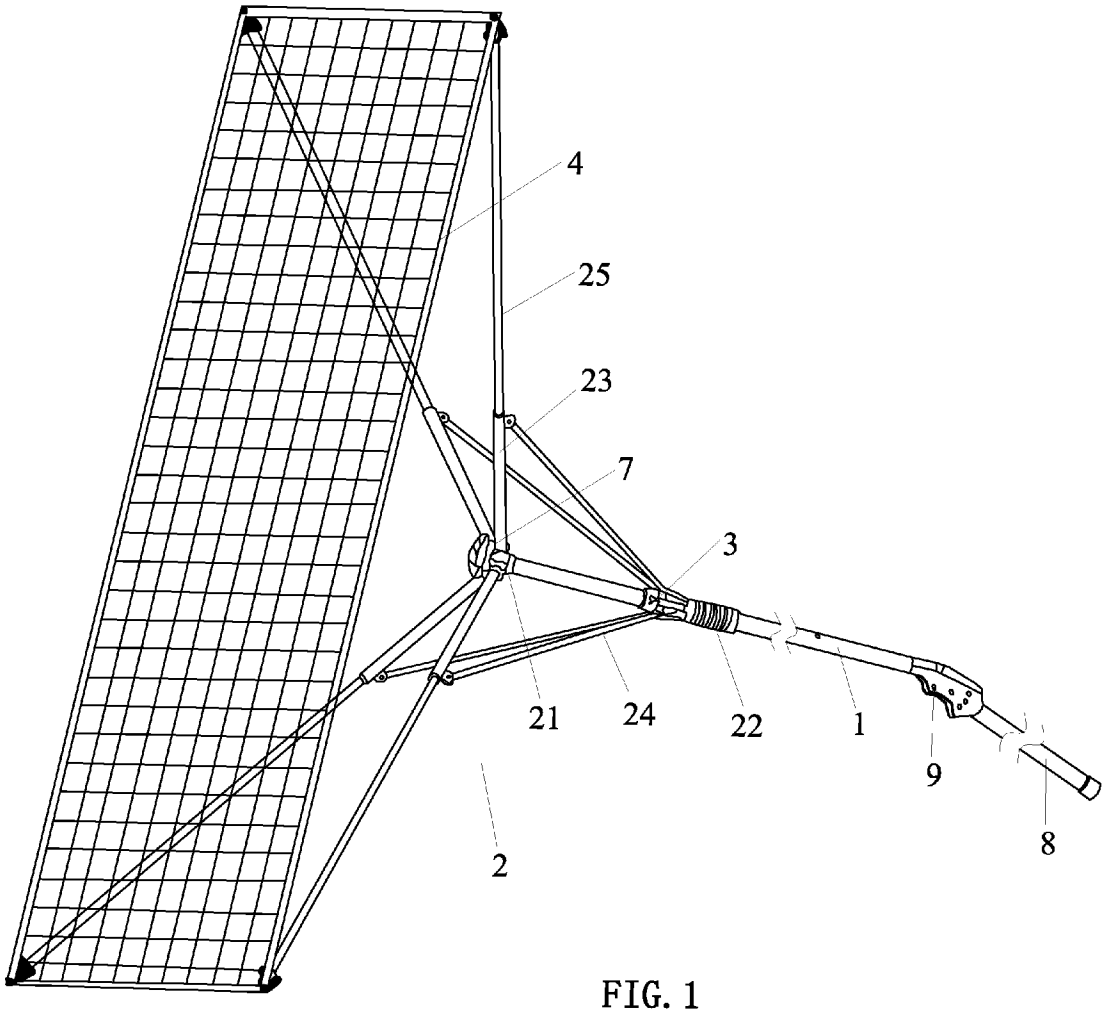
FIG. 1 is a perspective view according to a first embodiment of the present invention in an unfolded state (with the net)
Figure 2:
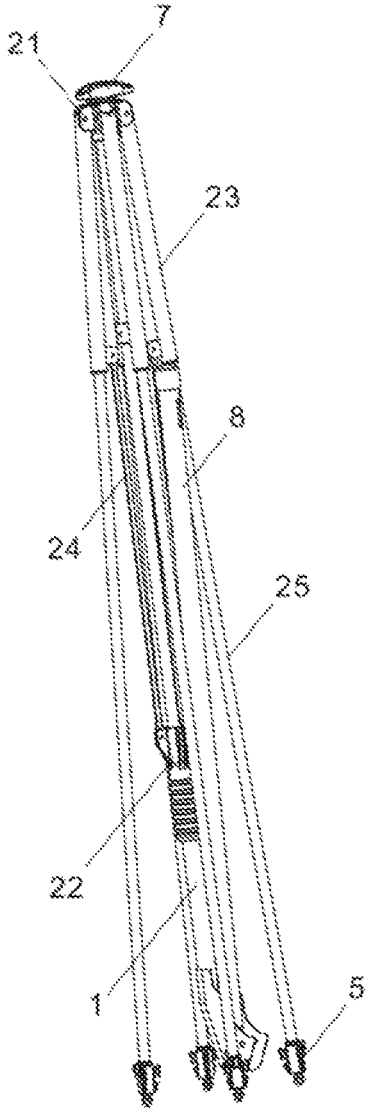
FIG. 2 is a perspective view according to the first embodiment of the present invention in a folded state (without the net)

Embodiments of the present invention will now be described, by way of example only, with reference to the accompanying drawings.

As shown in FIG. 1 to FIG. 8, the foldable ball net frame according to a first embodiment of the present invention comprises a main pipe 1, a foldable net frame 2, a stop ring 3, and a net 4.

The foldable net frame 2 comprises an upper collar 21 fixed at the top of the main pipe 1 and a lower collar 22 slidably fitted on the main pipe 1. The foldable net frame 2 further comprises four main support arms 23 and four secondary support arms 24 corresponding to the main support arms 23 respectively. One end of each main support arm 23 is hingedly connected to the upper collar 21. Another end of each main support arm 23 is hingedly connected to one end of the corresponding secondary support arm 24. Another end of each secondary support arm 24 is hingedly connected to the lower collar 22.

The stop ring 3 is disposed between the upper collar 21 and the lower collar 22, and locked on the main pipe 1.

The foldable net frame 2 further comprises support poles 25 corresponding in number to the main support arms 23. The support poles 25 and the main support arms 23 are coaxially structured. Each of the support poles 25 are disposed at each of the distal ends of each of the main support arms 23, respectively.

The net 4 is adapted to stop balls. According to the demand, the net 4 can be used to stop footballs, baseballs, golf balls and so on. In this embodiment, the net 4 is a rebound net, so that the ball can rebound after the ball hits the net 4 to get a certain rebound force. The net 4 of the present invention is not limited to a rebound net. The net 4 has buttonholes 41 corresponding in number to the support poles 25. The net 4 is detachably connected to the distal ends of the support poles 25 through the buttonholes 41.

When the lower collar 22 is moved toward the upper collar 21 along the main pip 1 to get contact with the stop ring 3, the secondary support arms 24 bring the main support arms 23 to move toward the front end of the main pipe 1 to unfold in a Y shape. The net 1 is connected to the support poles 25 through the buttonholes 41 and tightens the distal ends of the support poles 25. Adjacent two of the support poles 25 and the main pipe 1 form a tripod configuration to support the entire net frame on the ground as a ball rebound device. The ball can rebound when the ball hits the net 4 so as to pick up the ball conveniently. After the net 4 is detached from the support poles 25, the lower collar 22 is moved away from the upper collar 21 along the main pipe 1 and the secondary support arms 24 bring the main support arms 23 to move toward the rear end of the main pipe 1 to fold the net frame 2. The present invention is convenient for carrying and storage.

The support poles 25 can be carbon fiber poles.

Figure 3:
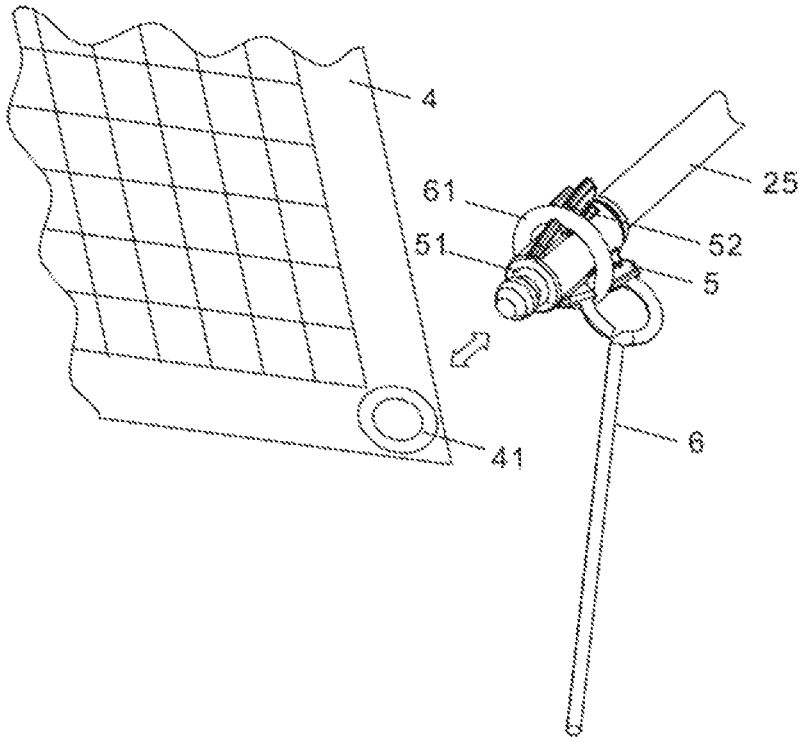
FIG. 3 is a schematic view showing the configuration of the support poles and the net according to the first embodiment of the present invention.

As shown in FIG. 3, the distal end of each support pole 25 is provided with a plastic sleeve 5. The distal end of the plastic sleeve 5 has an annular recess 51 for engagement of the corresponding buttonhole 41 of the net 4. The plastic sleeve 5 has an engaging trough 52. The engaging trough 52 is provided with a peg 6. The peg 6 can be plugged into the ground to fix the distal end of the support pole 26 to the ground so as to enhance the resistance of the entire net frame against impact.

Furthermore, an elastic band 61 is provided in the engaging trough 52. The peg 6 is connected to the elastic band 61. Through the elasticity of the elasticity band 61, the resistance against impact of the entire net frame can be further enhanced.

Figure 4:
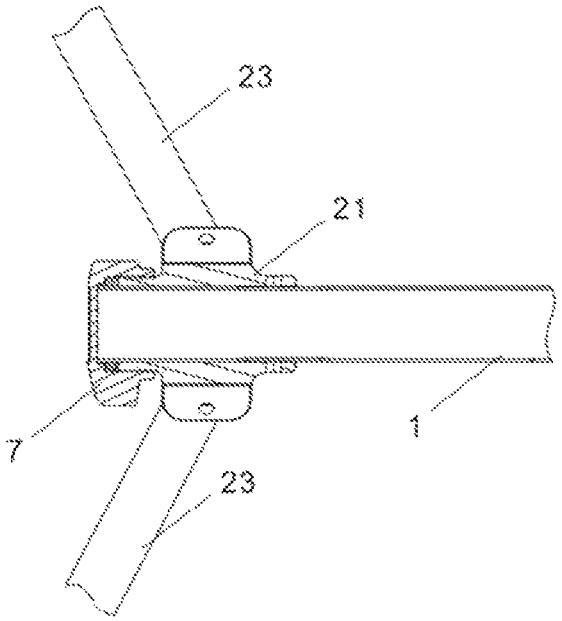
FIG. 4 is a schematic view showing the end cover according to the first embodiment of the present invention.

As shown in FIG. 4, the front end of the main pipe 1 is provided with a coaxial end cover 7. The bottom of the end cover 7 and the top of the upper nest 23 are connected through theads. The end cover 7 is rotatable for slightly adjusting the height of the upper nest 21. When the lower nest 22 is moved toward the upper nest 21 along the main pip 1 to get contact with the stop ring 3, the secondary support arms 24 bring the main support arms 23 to move toward the front end of the main pipe 1 to unfold in a Y shape. At this time, the end cover 7 is rotated to slightly adjust the height of the upper nest 21, namely, the unfolded angle of the main support arms 21 can be obviously adjusted and positioned to tighten the net 4 properly.

Figure 5:
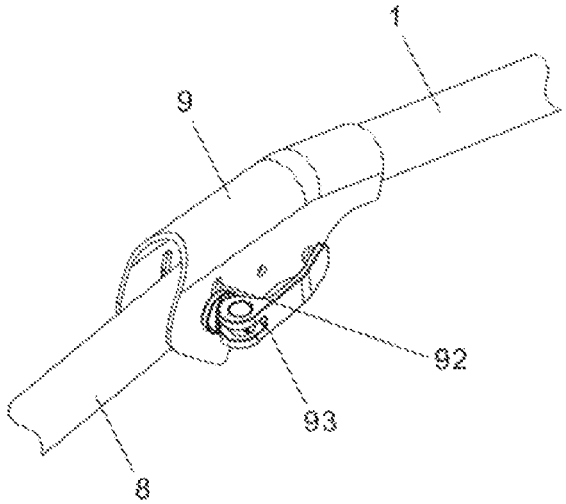
FIG. 5 is a schematic view showing the foldable pipe according to the first embodiment of the present invention.
Figure 6:
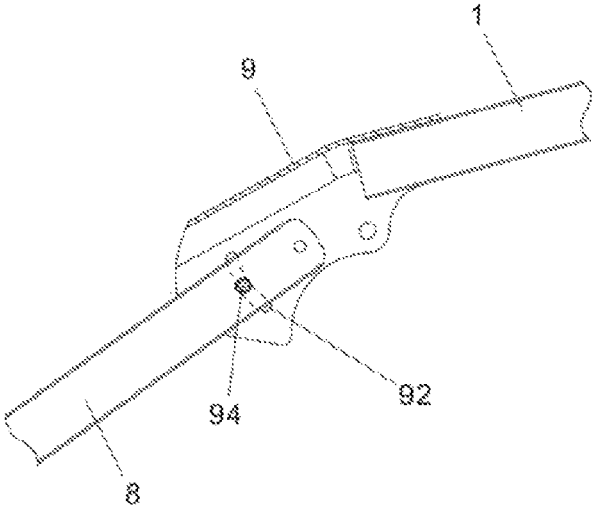
FIG. 6 is a sectional view showing the foldable pipe according to the first embodiment of the present invention.

As shown in FIG. 5 and FIG. 6, to allow the rebound angle of the net 4 to have room for adjustment in its angle, the rear end of the main pipe 1 is provided with a foldable pipe 8. The main pipe 1 and the foldable pipe 8 are connected through a joint. The top of the joint 9 is fixed to the rear end of the main pipe 1. The top of the foldable pipe 8 is hingedly connected in the joint 9. Two side walls of the tail of the joint 9 have corresponding arc recesses 92. The foldable pipe 8 is provided with a connecting pin 94. Two ends of the connecting pin 94 are inserted through the arc recesses 92, respectively. One of the two ends of the connecting pin 94 is hingedly connected with a quick-release member 93 which is disposed at the outside of the joint 9. When the quick-release member 93 is locked, the connecting pin 94 is fixed in the joint 9. When the quick-release member 93 is unlocked, the connecting pin 94 can slide along the arc recesses 92 to adjust the inclined angle between the main pipe 1 and the foldable pipe 8 so as to adjust the rebound angle of the net 4.

Figure 7:
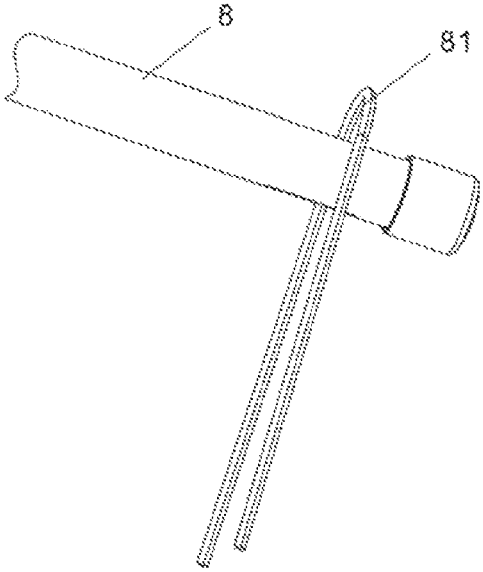
FIG. 7 is a schematic view showing the tail peg of the foldable pipe according to the first embodiment of the present invention.

As shown in FIG. 7, the tail of the foldable pipe 8 has a through hole. A tail peg 81 is inserted through the through hole to the ground. This also enhances the resistance to an impact.

Figure 8:
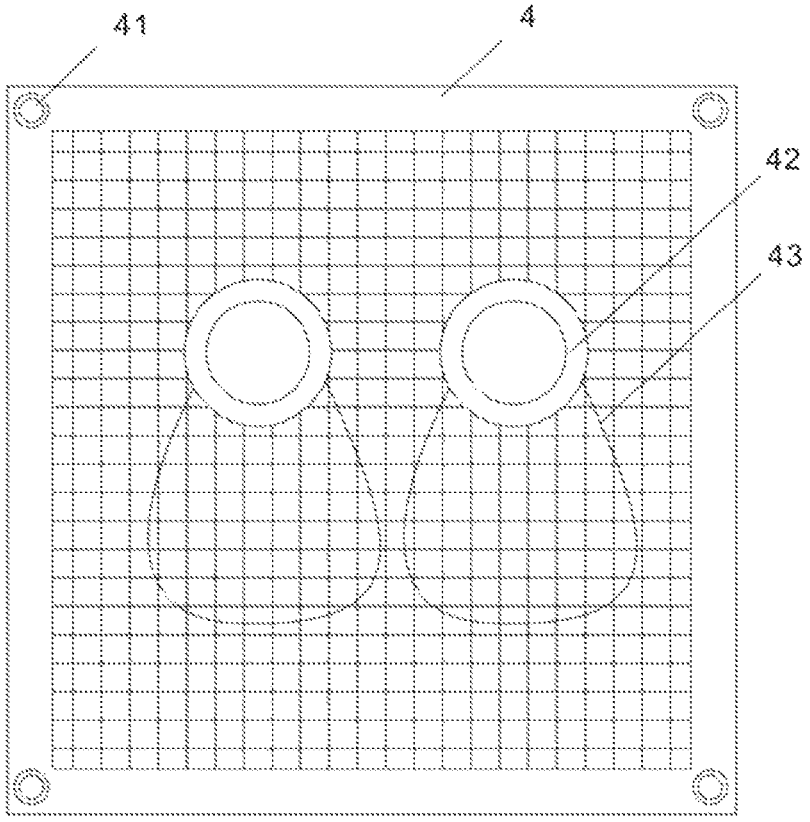
FIG. 8 is a schematic view showing the net according to the first embodiment of the present invention.
Figure 9:
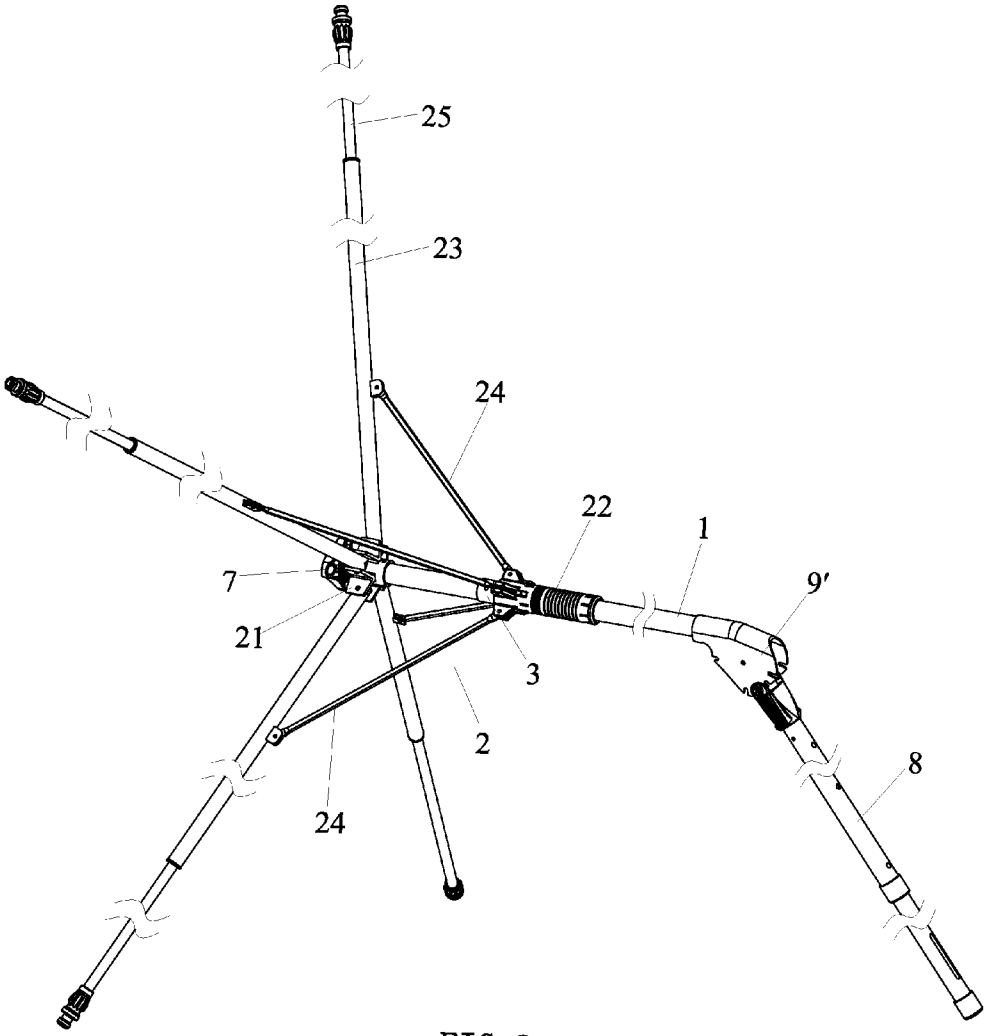
FIG. 9 is a perspective view according to a second embodiment of the present invention in an unfolded state (with the net provided)
Figure 10:
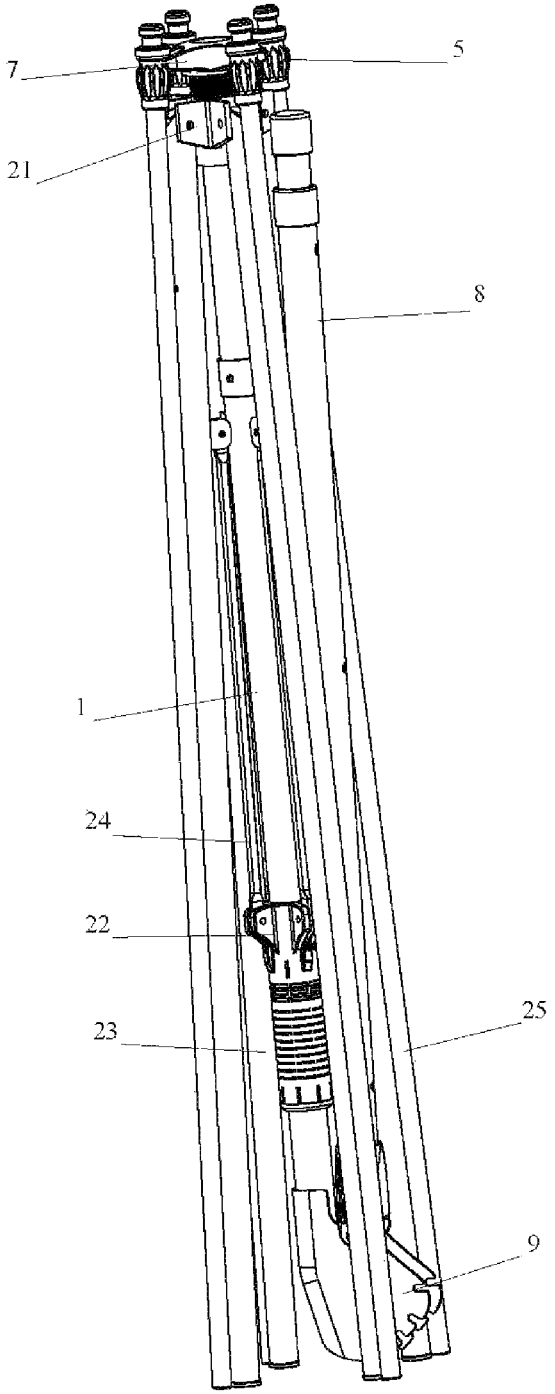
FIG. 10 is a perspective view according to the second embodiment of the present invention in a folded state (without the net provided)
Figure 11:
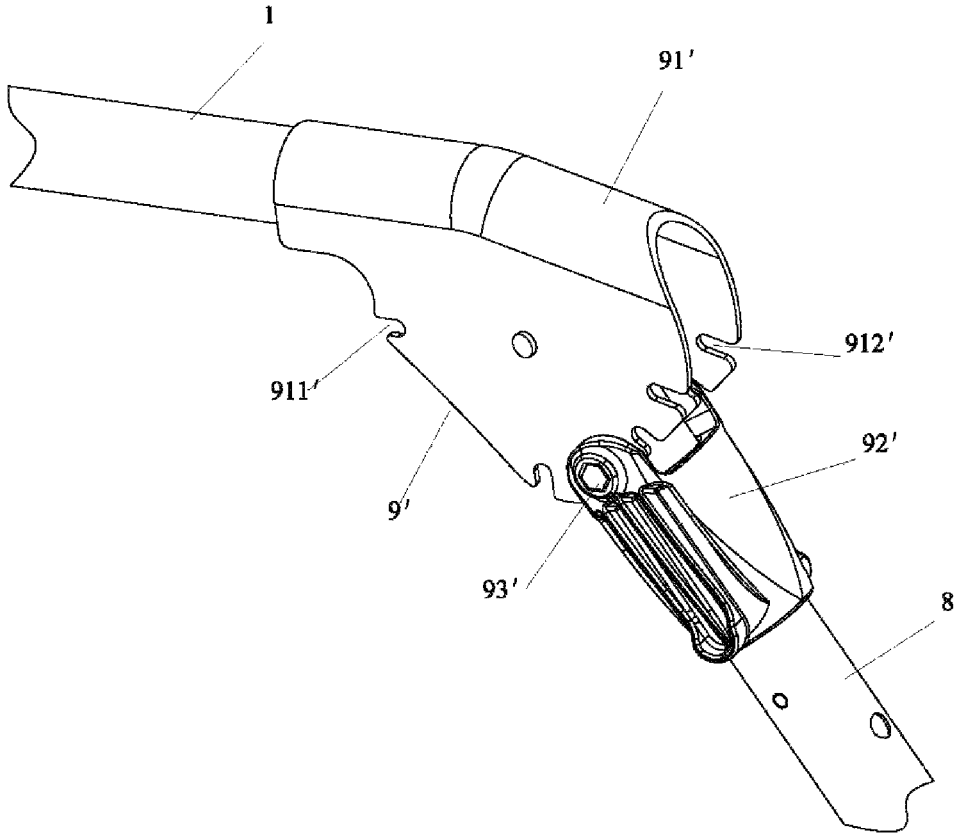
FIG. 11 is a schematic view showing the foldable pipe according to the second embodiment of the present invention.
Figure 12:
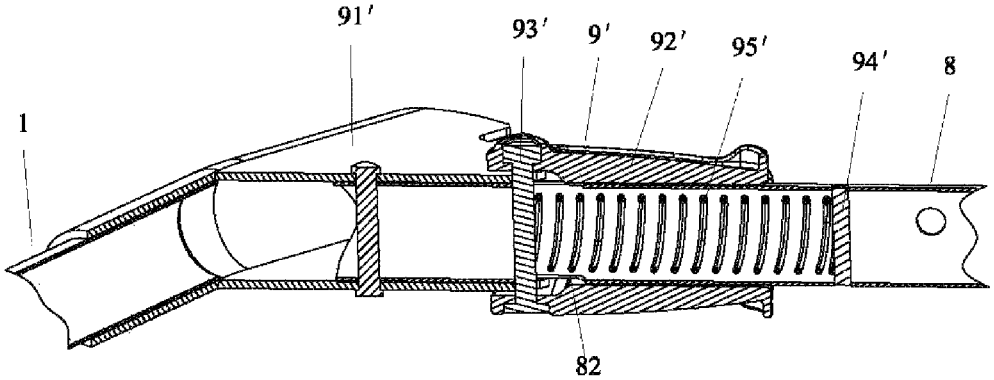
FIG. 12 is a sectional view showing the foldable pipe according to the second embodiment of the present invention.

As shown in FIG. 8, the net 4 has a window hole 42 for a ball to pass therethrough. The user can aim the ball at the window hole 42 for playing a game or training. If the ball is not thrown into the window hole 42, it will rebound for the user to pick up the ball conveniently. Furthermore, the net 4 is provided with a ball collection bag 43 behind the window hole 42 to collect the ball passing through the window hole 42.

As shown in FIG. 9 to FIG. 12, a second embodiment of the present invention is substantially similar to the first embodiment with differences described hereinafter.

In this embodiment, the main pipe 1 and the foldable pipe 8 are connected through a lock mechanism 9'. The lock mechanism 9' comprises a joint 91', a pull member 92', a lock pin 93', a stop member 94', and a spring 95'. The top of the joint 91' is fixed to the rear end of the main pipe 1. The top of the foldable pipe 8 is hingedly connected in the joint 91'. The joint 91' has an engaging notch 911' and a plurality of adjustment notches 912'. The pull member 92' is slidably fitted on the foldable pipe 8. The foldable pipe 8 has an axial slide groove 82. The lock pin 93' is fixed to the pull member 92 and inserted in the slide groove 82. The pull member 92' is a sleeve. The pull member 92' is used to control the lock pin 93' to disengage from the engaging notch 911' or the adjustment notch 912'. The stop member 94' is disposed in the foldable pipe 8. The spring 95' is disposed between the lock pin 93' and the stop member 94'. The lock pin 93' is biased by the spring 95' to be engaged in the engaging notch 911' or one of the adjustment notches 912'. The lock pin 93' is driven by the spring 95' and the pull member 92' to be engaged in the engaging notch 911' or one of the adjustment notches 912' or to slide between the engaging notch 911' and each adjustment notch 912'. When in use, the lock pin 93' is adjusted to be engaged in one of the adjustment notches 912' to adjust the inclined angle between the foldable pip 8 and the main pipe 1 so as to adjust the rebound angle of the net 4. When the lock pin 93' is engaged in the engaging recess 911', the foldable pipe 8 and the main pipe 1 are folded each other.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A foldable ball net frame, comprising:

a main pipe having an upper end and a lower end;

a foldable net frame, comprising an upper collar fixed at an upper end of the main pipe, a lower collar slidably received on the main pipe, four main support arms, and four secondary support arms corresponding to the four main support arms respectively, a lower end of each of the four main support arms hingedly connected to the upper collar, and an upper end of each of the four main support arms hingedly connected to an upper end of each of the four secondary support arms, and a lower end of each of the four secondary support arms hingedly attached to the lower collar;

a stop ring including a lock mechanism disposed between the upper collar and the lower collar;

four support poles telescopically received within the upper ends of the four main support arms; and a net having four buttonholes corresponding to the four support poles, wherein the upper ends of each of the four support poles are releasably received within each of the four buttonholes;

wherein when the lower collar is slidably moved towards the upper collar and locked in place on the main pipe, the four secondary support arms move the main support arms outwardly towards a front end of the main pipe, opening the net frame in a "Y" configuration, and wherein when the net is removed from the four support poles, the lower collar is slidably moved on the main pipe away from the upper collar, and the four secondary support arms rotatably move the four main support arms towards a lower end of the main pipe folding the net frame into a closed position.

2. The foldable ball net frame of claim 1, wherein a joint connects the lower end of the main pipe to an upper end of a foldable pipe, wherein the joint includes a tail portion having two side walls each having corresponding arc-shaped recess therein, the foldable pipe further comprising a connecting pin, having first and second ends, wherein the first and second ends are inserted in each of the arc-shaped recess respectively, at least one of the first and second ends is hingedly connected with a quick-release member on an outer surface of the joint, wherein when the quick-release member is locked, the connecting pin is fixed in the joint; and wherein when the quick-release member is unlocked, the connecting pin slides along the arc-shaped recess to adjusted an inclined angle between the main pipe and the foldable pipe.

3. The foldable ball net frame of claim 1, wherein a lock mechanism, releasably connecting the main pipe to a foldable pipe wherein the lock mechanism comprises a joint, a pull member, a lock pin, a stop member and a spring, and wherein an upper end of the joint is fixed to the lower end of the main pipe, an upper end of the foldable pipe is hingedly connected in the joint, the joint including an engaging notch and a plurality of adjustment notches, wherein the pull member is slidably fitted on the foldable pipe, wherein the foldable pipe including an axial slide groove, and the lock pin is fixedly attached to the pull member and inserted in the slide groove, and the stop member is disposed in the foldable pipe, the spring is disposed between the lock pin and the stop member, and wherein the lock pin is moved by the spring and the pull member for engagement in the engaging notch or one of the adjustment notches, or to slide between the engaging notch and the adjustment notches.

4. The foldable ball net frame of claim 3, wherein the tail of the foldable pipe includes a through hole, and a tail peg is inserted through the through hole to the ground surface.

5. The foldable ball net frame of claim 1, wherein the support poles are formed of carbon fiber.

6. The foldable ball net frame of claim 1, wherein the distal end of each of the four support poles is provided with a plastic sleeve, and a distal end of the plastic sleeve includes an annular recess for engagement with the corresponding buttonholes.

7. The foldable ball net frame of claim 6, wherein the plastic sleeve has an engaging trough, wherein a peg adapted to plugged into the ground surface.

8. The foldable ball net frame of claim 7, wherein an elastic band connected to the peg is provided in the engaging trough.

9. The foldable ball net frame of claim 1, wherein the upper end of the main pipe includes a coaxial end cover, a lower end of the coaxial end cover is threadably connected to an upper of the upper collar wherein the coaxial end cover is rotatably adjustable to adjust the height of the upper collar.

10. The foldable ball net frame of claim 1, wherein the net is a rebound net, comprising an opening for a ball to pass therethrough, and a ball collection bag positioned behind the opening.

* * * * *